US007459058B2

(12) United States Patent
Snekkenes

(10) Patent No.: US 7,459,058 B2
(45) Date of Patent: Dec. 2, 2008

(54) FEED OF A MIXTURE OF CHIPS AND FLUID FROM A LOW-PRESSURE SYSTEM TO A HIGH-PRESSURE SYSTEM

(75) Inventor: Vidar Snekkenes, Karlstad (SE)

(73) Assignee: Metso Fiber Karlstad AB, Karlstad (SE)

( * ) Notice: Subject to any disclaimer, the term of this patent is extended or adjusted under 35 U.S.C. 154(b) by 227 days.

(21) Appl. No.: 10/596,660

(22) PCT Filed: Dec. 23, 2004

(86) PCT No.: PCT/SE2004/001985

§ 371 (c)(1),
(2), (4) Date: Jun. 20, 2006

(87) PCT Pub. No.: WO2005/064078

PCT Pub. Date: Jul. 14, 2005

(65) Prior Publication Data

US 2007/0095490 A1 May 3, 2007

(30) Foreign Application Priority Data

Dec. 30, 2003 (SE) ..... 0303582

(51) Int. Cl.
*D21C 7/06* (2006.01)
*D21C 3/24* (2006.01)

(52) U.S. Cl. ..... 162/17; 162/52

(58) Field of Classification Search ..... 162/17, 162/19, 29, 41, 52, 236, 246
See application file for complete search history.

(56) References Cited

U.S. PATENT DOCUMENTS

| | | | | |
|---|---|---|---|---|
| 6,120,646 | A * | 9/2000 | Snekkenes et al. | 162/236 |
| 7,112,256 | B2 * | 9/2006 | Snekkenes et al. | 162/19 |
| 7,279,070 | B2 * | 10/2007 | Snekkenes et al. | 162/71 |
| 2002/0059991 | A1 * | 5/2002 | Barrett et al. | 162/17 |
| 2005/0103454 | A1 * | 5/2005 | Lindstrom et al. | 162/19 |
| 2006/0037723 | A1 * | 2/2006 | Gustavsson et al. | 162/52 |
| 2006/0070709 | A1 * | 4/2006 | Snekkenes et al. | 162/19 |
| 2007/0095490 | A1 * | 5/2007 | Snekkenes | 162/17 |
| 2007/0187052 | A1 * | 8/2007 | Snekkenes | 162/17 |
| 2007/0187053 | A1 * | 8/2007 | Snekkenes et al. | 162/19 |
| 2008/0093041 | A1 * | 4/2008 | Snekkenes et al. | 162/175 |
| 2008/0202717 | A1 * | 8/2008 | Saetherasen et al. | 162/237 |
| 2008/0210392 | A1 * | 9/2008 | Snekkenes | 162/17 |

FOREIGN PATENT DOCUMENTS

| | | | |
|---|---|---|---|
| WO | WO 03078727 | A1 * | 9/2003 |
| WO | WO 2005064078 | A1 * | 7/2005 |

* cited by examiner

*Primary Examiner*—José A Fortuna
(74) *Attorney, Agent, or Firm*—Rolf Fasth; Fasth Law Offices

(57) ABSTRACT

Chips are sluiced from a low-pressure section to a high-pressure section with a sluice feeder. The fluid that is used to expel the chips from the sluice feeder principally includes pressurized fluid withdrawn from the treatment vessel. This pressurized fluid is normally withdrawn from the treatment vessel for recovery (REC). By using this pressurized fluid instead for expelling the chips from the sluice feeder and subsequently sending the previously pressurized fluid to the recovery system (REC), the requirement for high pressure pumps that consume large quantities of electrical energy can be considerably reduced.

7 Claims, 5 Drawing Sheets

FEED OF A MIXTURE OF CHIPS AND FLUID FROM A LOW-PRESSURE SYSTEM TO A HIGH-PRESSURE SYSTEM

PRIOR APPLICATION

This application is a U.S. national phase application based on International Application No. PCT/SE2004/001985,filed Dec. 23, 2004, claiminq priority from Swedish Patent Application No. 03035821, filed Dec. 30, 2003.

TECHNICAL AREA

The invention concerns a method for the feed of cellulose chips during continuous cooking.

THE PRIOR ART

When cooking cellulose chips in continuous digesters, the chips are transported from a feed system at atmospheric pressure or a pressure slightly above atmospheric pressure to an impregnation vessel or a digester in which the pressure is considerably higher, through what is known as a "transfer flow". Transport in the transfer flow is made possible in that the chips are formed into a slurry with a transport fluid, preferably a process fluid, which is subsequently separated from the chips in separation equipment, normally designated as a "top separator", when the chips have reached the impregnation vessel or the digester. The transport fluid is recirculated to the feed system through a return line. The transfer flow has comprised for a long time a special type of sluice feed, known as a "high-pressure feeder", that has been specially designed to resist and separate the large differences in pressure that exist between the two systems. This high-pressure feeder is equipped with a rotor with symmetrical through pockets that are placed alternately in connection with the low-pressure system and the high-pressure system when the rotor rotates, without there being allowed any form of communication between these systems. The chips can in this manner be transferred from one system with no excess pressure or at a low excess pressure, typically 0-4 bar (abs), and fed through the high-pressure feeder into a system with considerably higher pressure, typically 7-20 bar (abs).

FIG. 1 shows schematically a conventional feed system according to the prior art with a high-pressure feeder 33 and a bin flow 34, a transfer flow 6*a*, 45 and a return flow 50. The transfer flow is constituted by a transfer line 6*a* for the transport of chips that have been formed into a slurry with a transport fluid, and a return line 45 for the transport fluid. The transfer line 6*a* connects at its upper end to a top separator 47 arranged at the top of a treatment vessel 48 where excess transport fluid is separated from the chips, after which the transport fluid is returned to the high-pressure feeder 33 through the return line 45. The top separator 47 is symbolised here by a version that is fed downwards in a treatment vessel that is filled hydraulically, or by some other separation equipment arranged in the transfer line or at the upper section of the treatment vessel.

The return flow 50 controls the level of fluid in the chip bin 32 and ensures that sufficient fluid is available in order to feed the chips out from the high-pressure feeder 33.

Since the return flow 50 passes from low pressure to high pressure, at least one high-pressure pump 51 is required to be arranged in the return flow 50.

A major disadvantage of this design is that the high-pressure pump 51 must consume large amounts of electrical energy in order to transport chips from the chip bin 32 to the treatment vessel 48.

FIG. 2 shows a method according to SE 519262 with the aim of reducing the problems and disadvantages described above. A minimum amount of fluid is used in this case to transport the chips in the transfer line 6*b*' and the fluid can in this way be allowed to accompany the chips to the subsequent treatment vessel 60'. Thus, no return line and no associated pumps, valves or equipment for transport fluid are required, making the feed system cheaper than conventional feed systems. The high-pressure feeder 53' is fed with a mixture of chips and fluid from a chip bin 52' in which an L/W-ratio of between four and ten is established through the active addition of fluid $LIQ_A$. A conventional high-pressure feeder 53' is placed after the chip bin, and is equipped with a rotor with symmetrical through pockets (1, 2) that are alternately placed in connection with the chip bin 52' and the transfer line 6*b*'. When one of the pockets of the rotor opens by gradual rotation towards the chip bin 52' it becomes filled by the fluid that in the previous position fed the chips mixture out into the transfer line 6*b*'. The pocket facing the opposing flow line 54' opens at the same time and an open channel through the high-pressure feeder is created. The pocket is placed in the first position when it is located in this filling position.

Under the influence of one or more high-pressure pumps 57', 57" or under the influence of one pump with several pumping stages in the flow line 54', and under the influence of the static pressure that is formed by the column of fluid in the chip bin 52', the fluid in the pocket 1 will be extracted/expelled by suction at the same time as the chips mixture is fed into the pocket.

Furthermore, it can on occasions be desirable to add a makeup fluid $LIQ_B$ to the flow line 54'. This makeup fluid $LIQ_B$ is characterised by not being to any degree part of a withdrawal from subsequent separation equipment connected to the treatment vessel 60'.

The disadvantage of this design is that the high-pressure pumps mentioned above consume very large quantities of electrical energy.

Aim and Purpose of the Invention

The principal aim of the present invention is to offer a method that consumes little energy during the transport of chips mixture from a feed system that functions at a first, low pressure and that comprises a high-pressure feeder for the sluice feed of chips mixture to a treatment vessel in a cooking system for the continuous cooking of chemical cellulose pulp that functions at a second, higher pressure.

This is achieved according to the invention through a method that demonstrates the characteristics specified in claim 1.

A further aim is to fully or partially remove the requirement for high-pressure pumps, which consume large amounts of electrical energy. These high-pressure pumps are described above in the summary of the prior art.

A further aim is to fully or partially exploit the pressurised fluid withdrawn from a subsequent digester or impregnation vessel at a pressure that is essentially maintained and that corresponds to the pressure established in these, which fluid withdrawal normally passes to a recovery system through a pressure-reducer, and instead to use these pressurised fluids in order to transport chips out from the high-pressure feeder.

BRIEF DESCRIPTION OF THE INVENTION

The invention is characterised in that it fully or partially reduces the requirement for high-pressure pumps in order to pump fluid from low pressure to high pressure in association with the transport of chips from a chip bin to a treatment vessel. These high-pressure pumps, which consume a large amount of electrical energy, have been described in more detail above in the description of the prior art.

This is achieved through exploiting, fully or partially, the pressurised fluid withdrawn from the treatment vessel, which is normally withdrawn and passed to a recovery system, and using instead this pressurised fluid to expel chips from the high-pressure feeder, before the previously pressurised fluid is passed to the recovery system, either directly or via a chip bin or an impregnation vessel.

The amount of fluid that passes to the recovery system after the high-pressure feeder is equivalent to the amount of fluid that is required to pump up to high pressure by means of a high-pressure pump in the prior art.

The requirement for large amounts of electrical energy that is required for the use of high-pressure pumps according to the prior art can, according to the invention, be reduced by up to 50%.

The saving in the pumping power required is proportional to the portion that is withdrawn under pressure from the digester and that during its passage through the sluice feeder is later led to the recovery system, either directly or via a chip bin or impregnation vessel.

The pressurised portion has in this case been used to raise the pressure of the chips suspension at the removal position, and since this portion is passed to the recovery system it does not need to be repressurised with a return line 71, 72.

Further characteristics and aspects, together with advantages, of the invention are made clear by the attached claims and by the detailed description of a number of embodiments given below.

DESCRIPTION OF THE DRAWINGS

The prior art is described with reference to FIG. 1 and FIG. 2, where.

DETAILED DESCRIPTION OF PREFERRED EMBODIMENTS

The concept of "treatment vessel 60"" will be used in the following description of preferred embodiments. The treatment vessel 60" can be either a pressurised digester or a pressurised impregnation vessel.

The concept "pressurised fluid" will also be used. The term "pressurised fluid" is here used to denote a pressurised withdrawal of fluid that has been taken from a treatment vessel 60" and that is characterised in that it is pressurised and maintained at a pressure level that essentially corresponds to the pressure that has been established in the treatment vessel 60". This pressurised fluid can be withdrawn from a top separator 91 on a treatment vessel 60" or from a strainer 90 on a treatment vessel 60" at a position in the treatment vessel 60" at which the chips have had a retention time greater than 60 minutes, preferably greater than 100 minutes.

Furthermore, the concept "previously pressurised fluid" will be used. The term "previously pressurised fluid" is here used to denote pressurised fluid that has been used in order to empty the sluice feeder 53 at its high-pressure position (the emptying position), the pressure of which is subsequently reduced at the subsequent rotation of the pocket of the sluice feeder to the low-pressure position, whereby this fluid has passed the sluice feeder 53 and thus is no longer under pressure.

Finally, the concepts "recovery $REC_{kik}$", "recovery $REC_{extr}$" and "recovery $REC_{tot}$" will be used.

The term "recovery $REC_{kik}$" is here used to denote a portion of the previously pressurised fluid that has been used to empty the sluice feeder 53, where this portion is subsequently forwarded directly to the recovery system or indirectly to the recovery system via a black liquor impregnation or a pre-impregnation. The term "recovery $REC_{extr}$" is here used to denote a fluid withdrawal that has been withdrawn from a chip bin 52" or from an impregnation vessel 60" and where this fluid is forwarded to a recovery system.

The term "recovery $REC_{tot}$" is here used to denote the total amount of all fluids from the treatment vessel 60" that are forwarded to the recovery system or to black liquor impregnation or pre-impregnation.

The fluids that are withdrawn via $REC_{kik}$ and $REC_{extr}$ for recovery cannot exceed $REC_{tot}$ and they cannot exceed the amount of new fluid that is fed into the system together with the chips.

Figure 1:
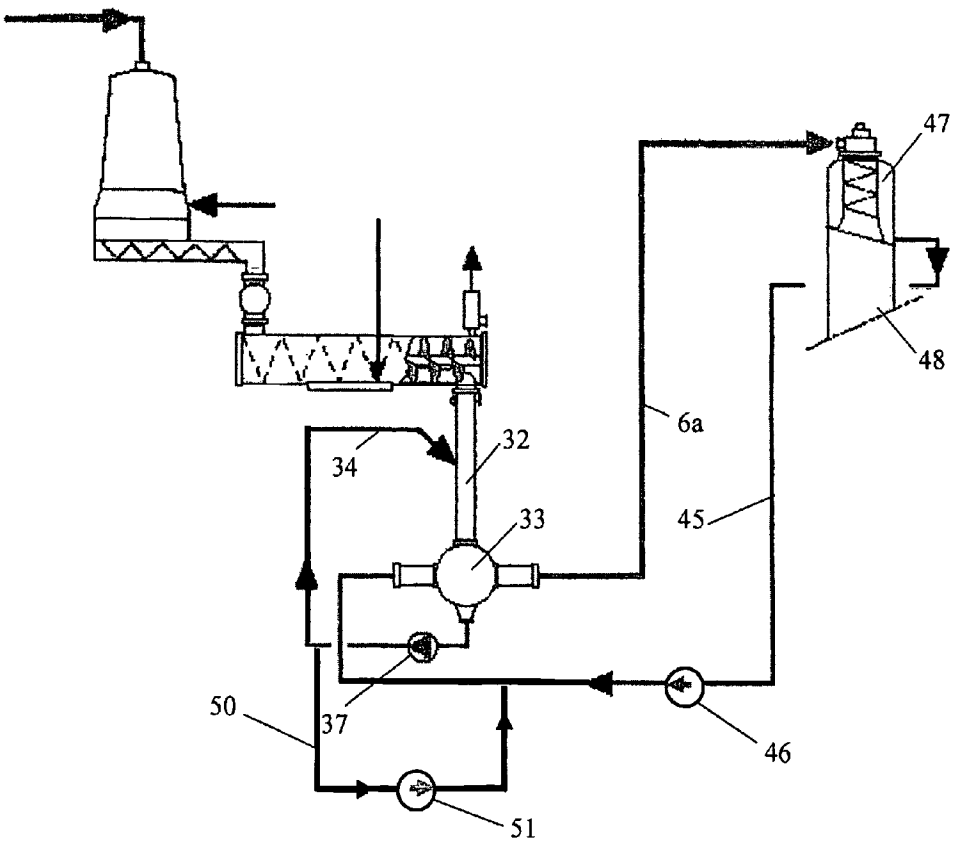
PRIOR ART FIG. 1
FIG. 1 shows schematically a conventional feed system with a high-pressure feeder and a bin flow and a transfer flow.
Figure 2:
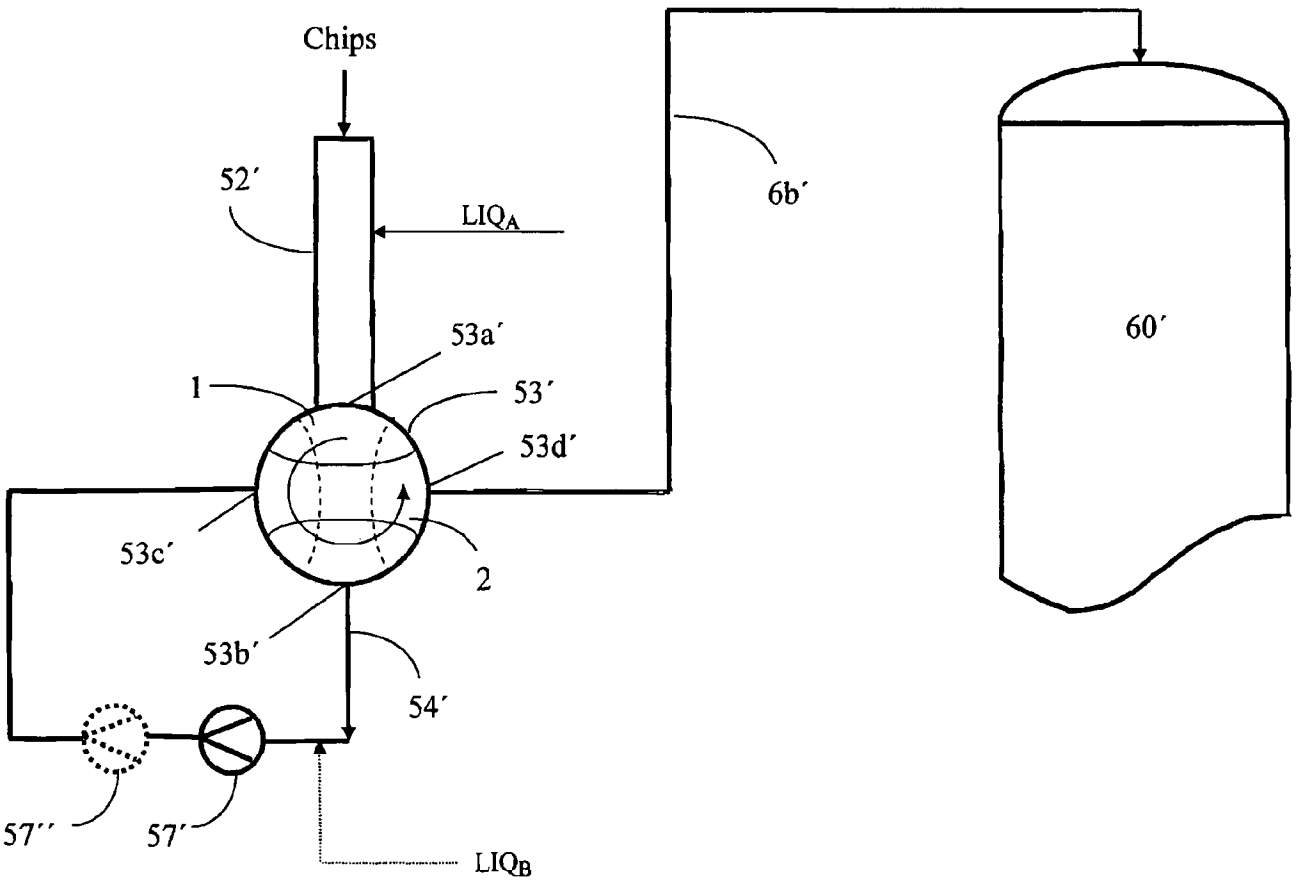
PRIOR ART FIG. 2
FIG. 2 shows schematically a feed system according to subsequently developed technology without a bin flow and a transfer flow with a return line (according to SE 519262)
Figure 3:
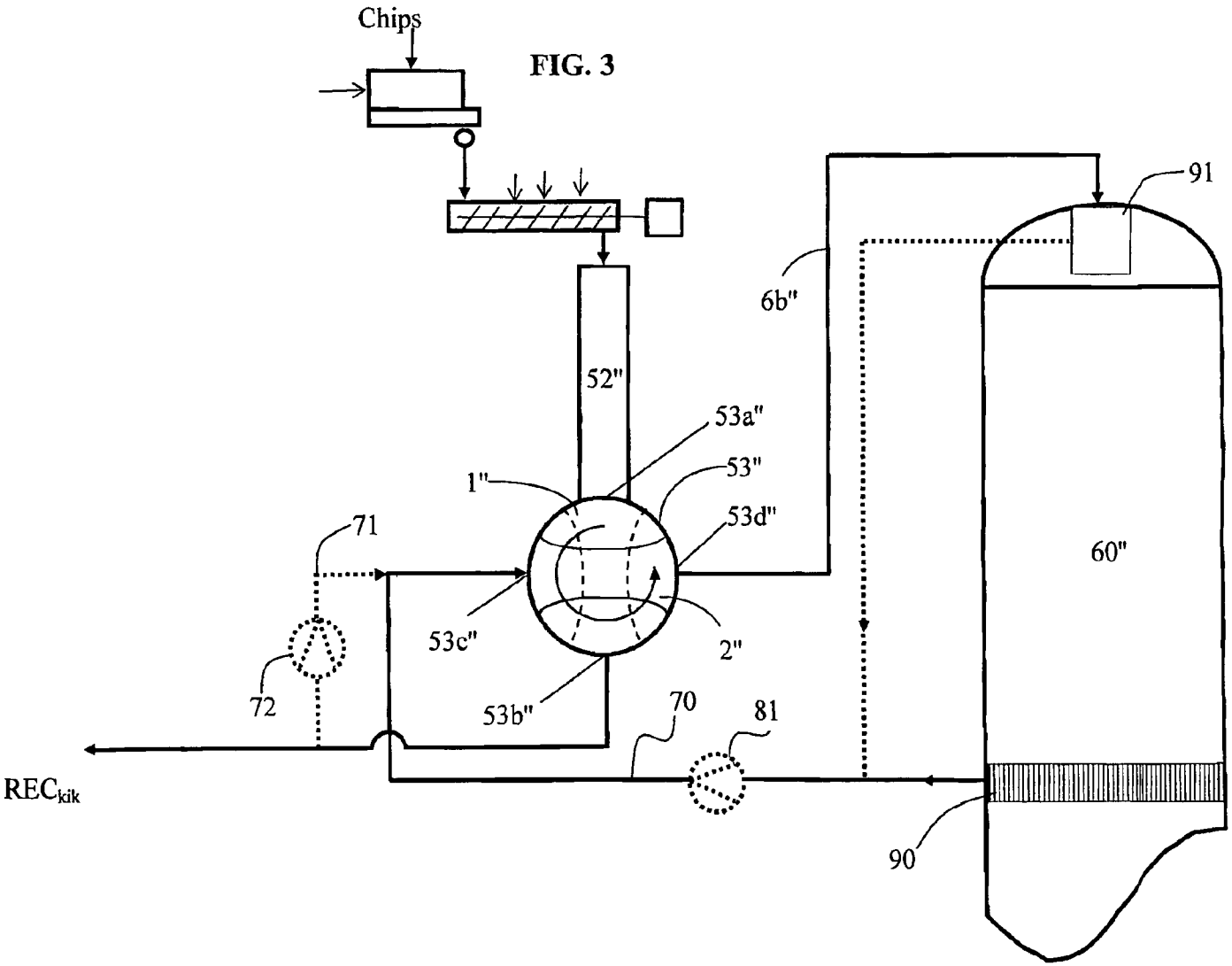
FIG. 3 shows a first, a second and a fifth preferred embodiment according to the invention.

FIG. 3 shows a first preferred embodiment according to the invention in the form of a method for the feed of a mixture of cellulose chips and fluid from a low-pressure system to a high-pressure system during the continuous cooking of chemical cellulose pulp. The feed of fluid and cellulose chips between these systems takes place through a sluice feeder 53". The sluice feeder 53" is equipped with a first inlet 53*a*", a second inlet 53*c*", a first outlet 53*b*" and a second outlet 53*d*". The sluice feeder 53" further comprises a rotor with a first 1" and a second 2" through pocket, which are placed alternately in connection with the high-pressure system and the low-pressure system.

The first pocket 1" is located at a first position and is placed via the first inlet 53*a*" in connection with a chip bin 52" while the pocket 1" is filled with the chips mixture, while at the same time expulsion of the fluid that is present in the pocket 1" takes place via the first outlet 53*b*″.

The second pocket 2" is located at a second position and is placed via the second outlet 53*d*" in connection with a transfer line 6*b*" in the high-pressure system, while the chips mixture is fed out from the pocket 2" for transport onwards to a treatment vessel 60" in the high-pressure system with the aid of a fluid that is fed into the pocket 2" through the second inlet 53*c*″.

The second inlet 53*c*" is connected via at least one withdrawal line 70 to the treatment vessel 60", from which pressurised fluid is withdrawn. At least a portion of this pressurised fluid is withdrawn from the treatment vessel 60" with a strainer 90 at a position in the treatment vessel 60" at which the chips have had a retention time greater than 60 minutes, preferably greater than 100 minutes.

In one variant of this embodiment, a portion of the pressurised fluid can also be constituted by fluid withdrawn from a top separator 91 on the treatment vessel 60".

A supplementary pump 81 may be used, where required, to pump the pressurised fluid to the second inlet 53*c*" of the sluice feed. The pressurised fluid is used to expel the chips mixture from the pocket 1" of the sluice feeder when the pocket is placed in connection with the high-pressure system.

The previously pressurised fluid is withdrawn at the first outlet 53*b*" of the sluice feeder from the pocket 1" and where a portion ($REC_{kik}$) of the previously pressurised fluid is forwarded to the recovery system and where this portion constitutes at least 20% of the total amount ($REC_{tot}$) that is passed to the recovery system, while constituting at least 1 $m^3$/tonne of pulp with the aim of reducing the total amount of electrical energy required to pump the chips suspension from low pressure to high pressure through the sluice feeder 53.

A second preferred embodiment is also shown in FIG. 3. It can occasionally be possible that the complete amount of previously pressurised fluid that has been withdrawn from the pocket 1" at the first outlet 53*b*" of the sluice feeder ($REC_{kik}$) is sent to the recovery system, for reasons relating to the process.

Figure 4:
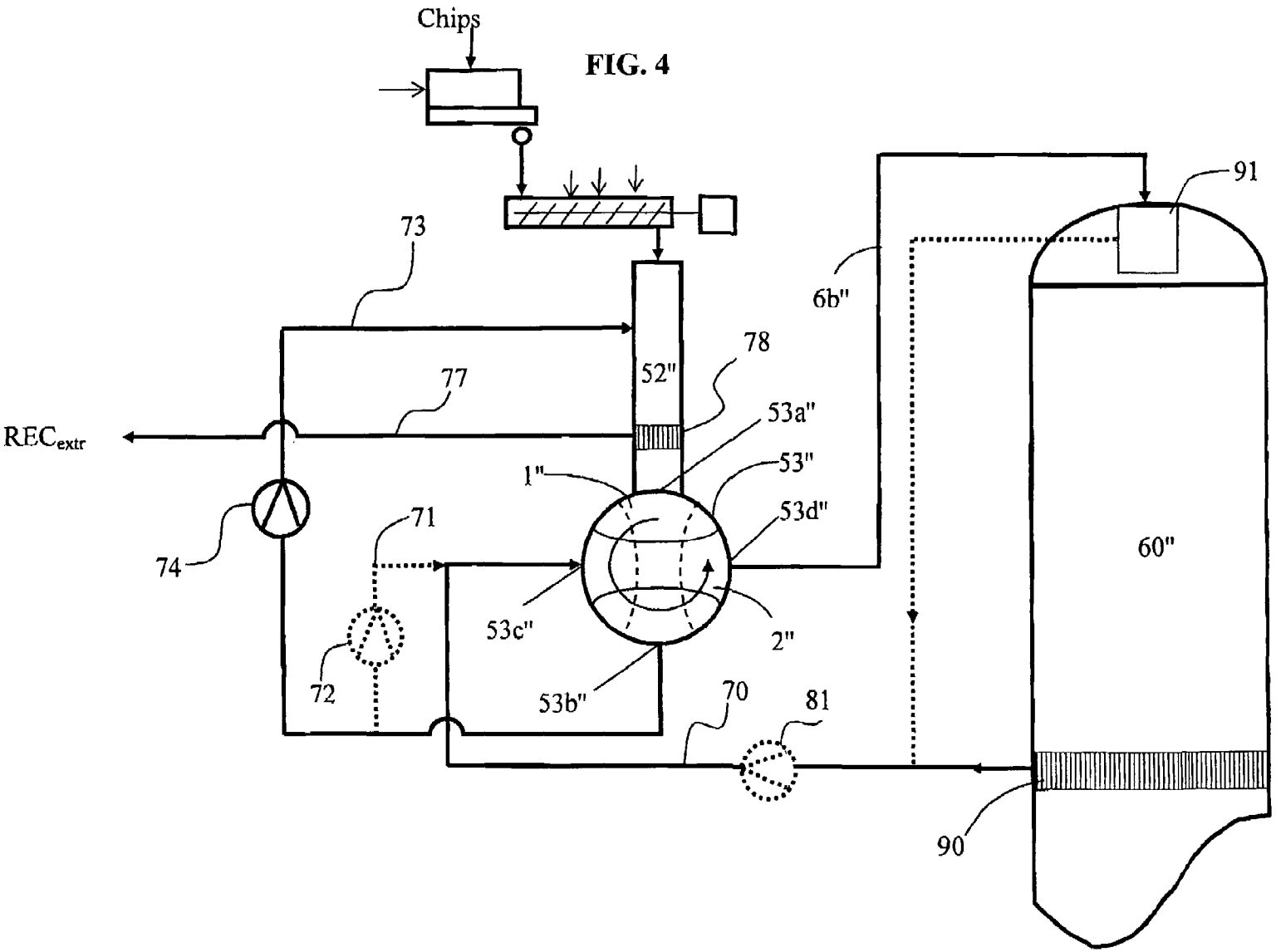
FIG. 4 shows a third and a fifth preferred embodiment according to the invention.

FIG. 4 shows a third preferred embodiment, in order to establish a desired L/W ratio in the chip bin. In this embodiment, the main part of the previously pressurised fluid after the first outlet 53*b*" of the sluice feeder on the low-pressure side is allowed to pass to the chip bin, arranged before the sluice feeder 53. This main part of previously pressurised fluid is transported in a bin flow line 73. A pump 74 may be used, where required, to pump the previously pressurised fluid to the chip bin 52". The chip bin 52" has a volume that gives a retention time of the previously pressurised fluid in a chips mixture of at least 10 minutes before the previously pressurised fluid ($REC_{extr}$) is withdrawn to the recovery system via a recovery line 77 that extends from the withdrawal strainer 78 on the chip bin 52".

Figure 5:
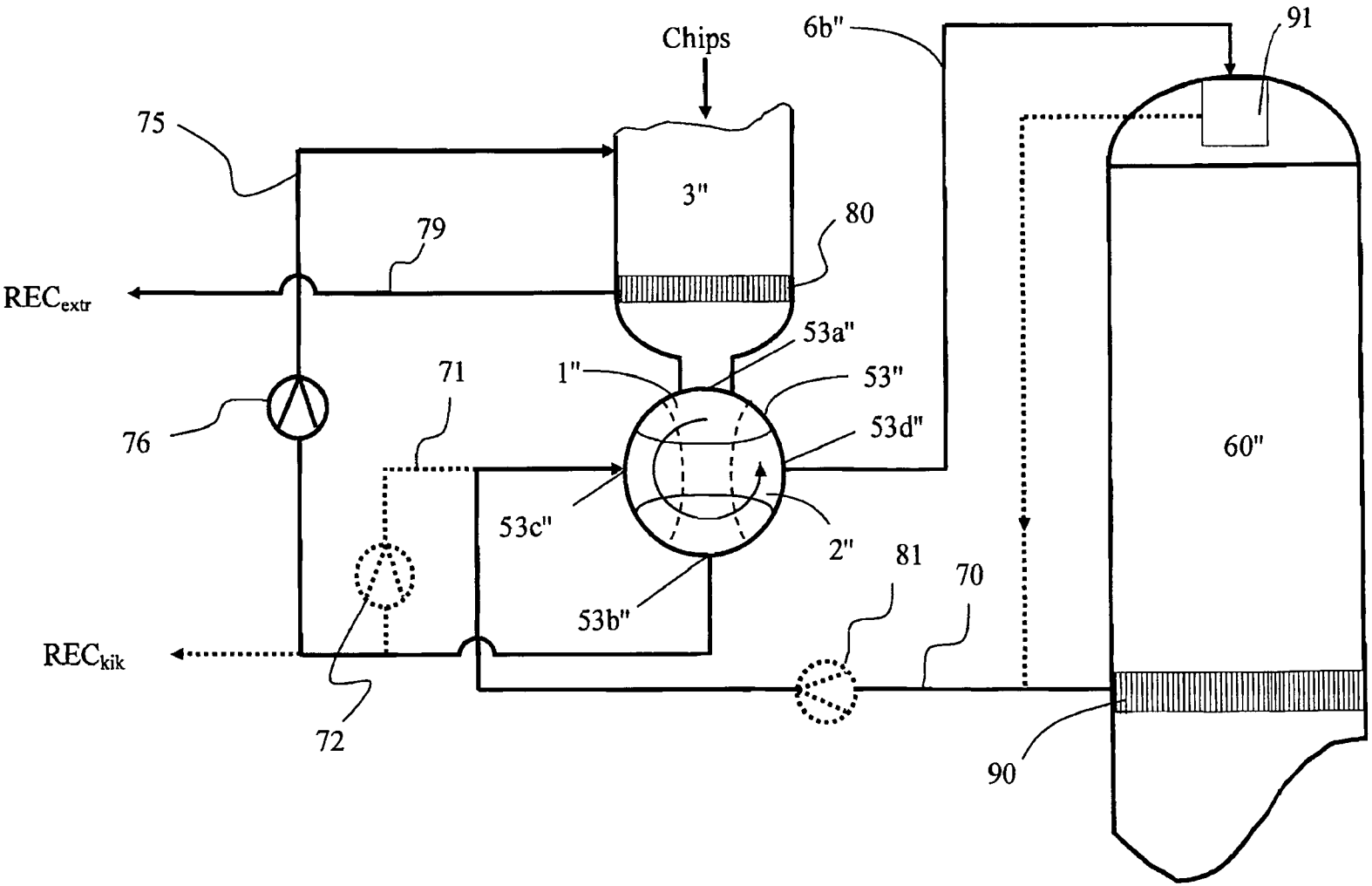
FIG. 5 shows a fourth and a fifth preferred embodiment according to the invention.

FIG. 5 shows a fourth preferred embodiment according to the invention in the form of a method for the feed of a mixture of cellulose chips and fluid from a low-pressure system to a high-pressure system during the continuous cooking of chemical cellulose pulp. The feed of fluid and cellulose chips between these systems takes place through a sluice feeder 53". The sluice feeder 53" is equipped with a first inlet 53*a*", a second inlet 53*c*", a first outlet 53*b*" and a second outlet 53*d*". The sluice feeder 53" further comprises a rotor with a first 1" and a second 2" through pocket, which are placed alternately in connection with the high-pressure system and the low-pressure system.

The first pocket 1" is located at a first position and is placed via the first inlet 53*a*" in connection with an impregnation vessel 3" essentially at atmospheric pressure while the pocket 1" is filled with the chips mixture, while at the same time expulsion of the fluid that is present in the pocket 1" takes place via the first outlet 53*b*".

The second pocket 2" is located at a second position and is placed via the second outlet 53*d*" in connection with a transfer line 6*b*" in the high-pressure system, while the chips mixture is fed out from the pocket 2" for transport onwards to a treatment vessel 60" in the high-pressure system with the aid of a fluid that is fed into the pocket 2" through the second inlet 53*c*". The second inlet 53*c*" is connected via at least one withdrawal line 70 to the treatment vessel 60" from which pressurised fluid is withdrawn. At least a portion of this pressurised fluid is withdrawn from the treatment vessel 60" with a strainer 90 at a position in the treatment vessel 60" at which the chips have had a retention time greater than 60 minutes, preferably greater than 100 minutes.

In one variant of this embodiment, a portion of the pressurised fluid can also be constituted by fluid withdrawn from a top separator 91 on the treatment vessel 60".

A supplementary pump 81 may be used, where required, to pump the pressurised fluid to the second inlet 53*c*" of the sluice feed. The pressurised fluid is used to expel the chips mixture from the pocket 1" of the sluice feeder when the pocket is placed in connection with the high-pressure system. The previously pressurised fluid is withdrawn at the first outlet 53*b*" of the sluice feeder from the pocket 1" and where a portion ($REC_{kik}$) of the previously pressurised fluid is forwarded to the recovery system and where this portion constitutes at least 20% of the total amount ($REC_{tot}$) that is passed to the recovery system, while constituting at least 1 $m^3$/tonne of pulp with the aim of reducing the total amount of electrical energy required to pump the chips suspension from low pressure to high pressure through the sluice feeder 53. The main part of the previously pressurised fluid is passed onwards through a line 75 to the impregnation vessel 3", which is essentially at atmospheric pressure, arranged before the sluice feeder before a portion ($REC_{extr}$) of the previously pressurised fluid is forwarded through a line 79 to the recovery system via a withdrawal from a strainer 80 in the impregnation vessel 3", which is at atmospheric pressure.

Finally, a fifth preferred embodiment is shown in FIGS. 3, 4 and 5 that can be applied on all of the previously mentioned embodiments. It is sometimes desirable from considerations of the process to add a makeup fluid to the second inlet 53*c*" on the high-pressure side of the sluice feeder. This makeup fluid is a portion ($REC_{kik}$) of the previously pressurised fluid that was destined for recovery after the first outlet 53*b*" on the low-pressure side of the sluice feeder. The makeup fluid is transported through a recycling line 71 using at least one high-pressure pump 72.

Alternative Embodiments

With the high-pressure feeder located at a position after a chip bin, it has been traditional to arrange the high-pressure feeder such that its filling process takes place from above when a pocket in its first position has a vertical axis of symmetry, but the method according to the invention is not limited to this method of filling the high-pressure feeder. Filling can also be carried out with the axis of the symmetry of the pocket in a horizontal position. This may be particularly suitable when the high-pressure feeder is arranged after an impregnation vessel. The impregnation vessel is normally placed directly on the ground, due to its size, and thus it is not obvious that there is sufficient space for the filling of the high-pressure feeder from above. If the impregnation vessel is equipped with a bottom scraper, its motor will be centrally positioned under the bottom of the impregnation vessel, and this will probably ensure that it is necessary to place the high-pressure feeder to one side of the vertical axis of symmetry of the impregnation vessel, and it is thus no longer obvious that the filling of the high-pressure feeder is best carried out from above. A horizontal filling procedure may be suitable in this case, and a filling procedure from underneath may be considered.

The invention is not limited to the embodiments described. Several variants are possible within the framework of the claims.

While the present invention has been described in accordance with preferred compositions and embodiments, it is to be understood that certain substitutions and alterations may be made thereto without departing from the spirit and scope of the following claims.

The invention claimed is:

1. A method for feeding a mixture of cellulose chips and fluid from a low-pressure system to a high-pressure system during the continuous cooking of chemical cellulose pulp, comprising:

arranging a sluice feeder between the low-pressure system and the high-pressure system for sluice feeding fluid and cellulose chips, the sluice feeder having a first inlet, a second inlet, a first outlet and a second outlet defined therein, the sluice feeder having a rotor with a first pocket and a second pocket placed alternately in connection with the high-pressure system and the low-pressure system;

placing the first pocket, located in a first position, in connection with a chip bin or with an impregnation vessel while filling the first pocket with a chips mixture and at the same time expelling fluid present in the first pocket via the first outlet;

placing the second pocket, located in a second position, via the second outlet in connection with a transfer line in the high-pressure system while feeding the chips mixture out from the second pocket;

transporting the chips mixture onwardly to a treatment vessel in the high-pressure system with an aid of a fluid that is fed into the second pocket through the second inlet;

connecting the second inlet via at least one withdrawal line connected to the treatment vessel;

withdrawing pressurized fluid from the treatment vessel; positioning the first pocket into the second position so that the first pocket is in connection with the high-pressure system;

using the pressurized fluid to expel chips mixture from the first pocket when the first pocket is in connection with the high-pressure system;

positioning the first pocket in the first position so that the first pocket is in connection with the low-pressure system;

withdrawing previously pressurized fluid from the first pocket via the first outlet of the sluice feeder;

forwarding the previously pressurized fluid, withdrawn from the first outlet, directly to a recovery system wherein the withdrawn previously pressurized fluid constituting at least 20% of a total amount ($REC_{tot}$) withdrawn for recovery, while being at least 1 $m^3$/ton of pulp; and reducing a total amount of electrical energy required to pump a chips suspension from the low pressure system to the high pressure system through the sluice feeder.

2. The method according to claim 1, wherein a principal portion of the previously pressurized fluid is forwarded to a chip bin arranged before the sluice feeder before a portion ($REC_{extr}$) of the previously pressurized fluid is forwarded to the recovery system via a withdrawal from the chip bin.

3. The method according to claim 1 wherein a principal portion of the previously pressurized fluid is forwarded to an impregnation vessel essentially at atmospheric pressure arranged before the sluice feeder before a portion ($REC_{extr}$) of the previously pressurized fluid is forwarded to the recovery system via a withdrawal from the impregnation vessel which is at atmospheric pressure.

4. The method according to claim 1 wherein at least a portion of the pressurized fluid is withdrawn from the treatment vessel with a strainer at a position in the treatment vessel where chips have had a retention time greater than 60 minutes.

5. The method according to claim 4, wherein at least a portion of the pressurized fluid is withdrawn from a top separator on the treatment vessel.

6. The method according to claim 1 wherein a recirculation line has at least one high-pressure pump and extends from the first outlet of the sluice feeder to the second inlet of the sluice feeder for withdrawal of a portion of the previously pressurized fluid that has been expelled from the pockets of the sluice feed when the pockets are located at their first position, for the addition of the portion of the previously pressurized fluid as makeup fluid to the second inlet of the sluice feeder.

7. The method according to claim 1, wherein a complete amount ($REC_{kik}$) of the previously pressurized fluid is forwarded to the recovery system.

* * * * *